United States Patent [19]

Bologna et al.

[11] 4,134,240

[45] Jan. 16, 1979

[54] MOUNTING SYSTEM FOR AN ADD ON GLASS PANEL

[75] Inventors: John P. Bologna, Leechburg; Richard R. Lewchuk, Allison Park, both of Pa.

[73] Assignee: PPG Industries, Inc., Pittsburgh, Pa.

[21] Appl. No.: 841,162

[22] Filed: Aug. 1, 1977

Related U.S. Application Data

[63] Continuation of Ser. No. 686,847, May 17, 1976.

[51] Int. Cl.[2] ..... E06B 3/26

[52] U.S. Cl. ..... 52/202; 52/741

[58] Field of Search ..... 52/202, 203, 616, 171, 52/741

[56] References Cited

U.S. PATENT DOCUMENTS

| | | | |
|---|---|---|---|
| 2,716,783 | 9/1955 | Fegan | 52/202 |
| 3,202,054 | 8/1965 | Mochel | 52/171 X |

FOREIGN PATENT DOCUMENTS

| | | | |
|---|---|---|---|
| 478734 | 11/1951 | Canada | 52/202 |

*Primary Examiner*—Price C. Faw, Jr.
*Assistant Examiner*—Carl D. Friedman
*Attorney, Agent, or Firm*—Donald Carl Lepiane

[57] ABSTRACT

A glass panel is maintained in spaced relation to an existing window mounted in a fenestration by securing the panel to an abutment mounted on opposed sidwalls and top wall of the fenestration. The glass panel is coated to reduce passage of solar energy and/or radiant heat. Outside noises are dampened by providing (1) a resilient gasket between the abutment and the panel and (2) a resilient glazing foot between the bottom side of the panel and fenestration ledge.

7 Claims, 7 Drawing Figures

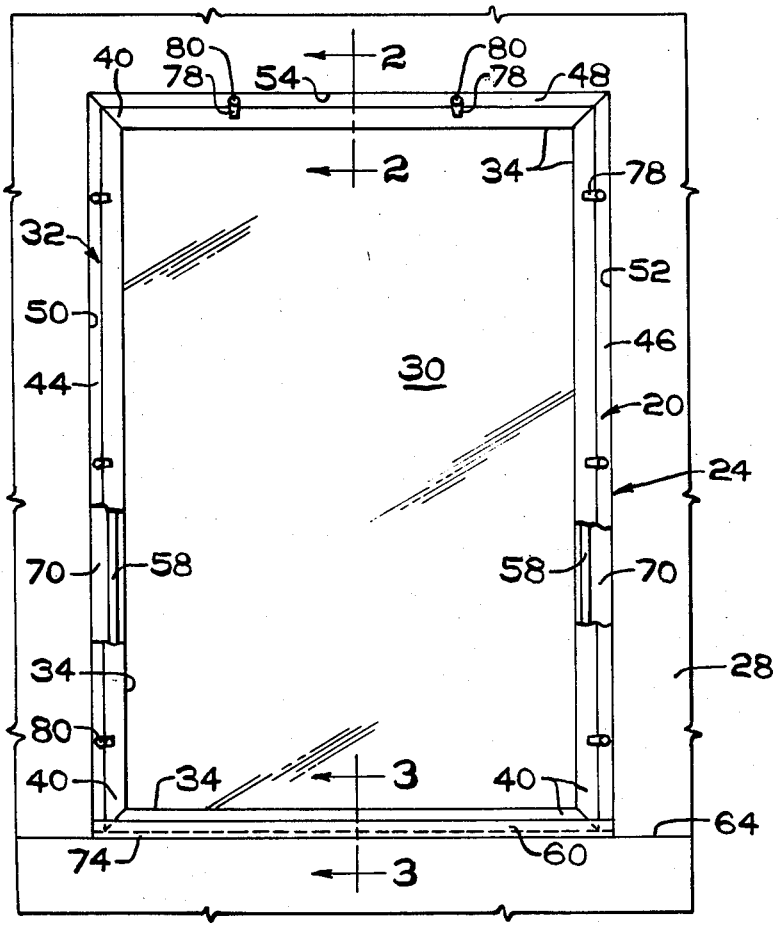
FIG. 1
FIG. 2
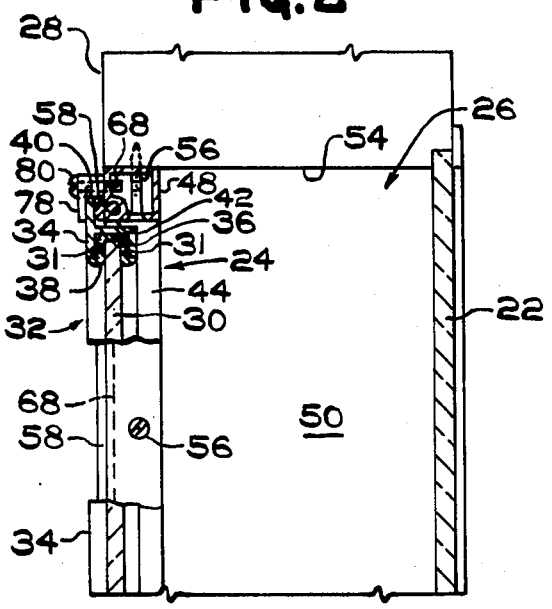
FIG. 3
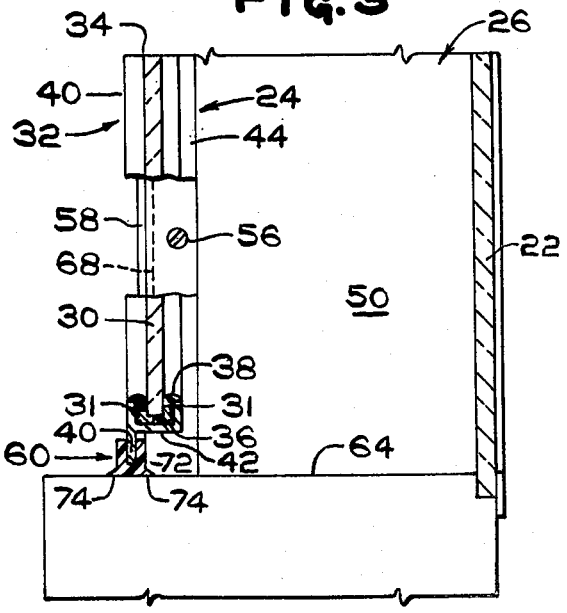

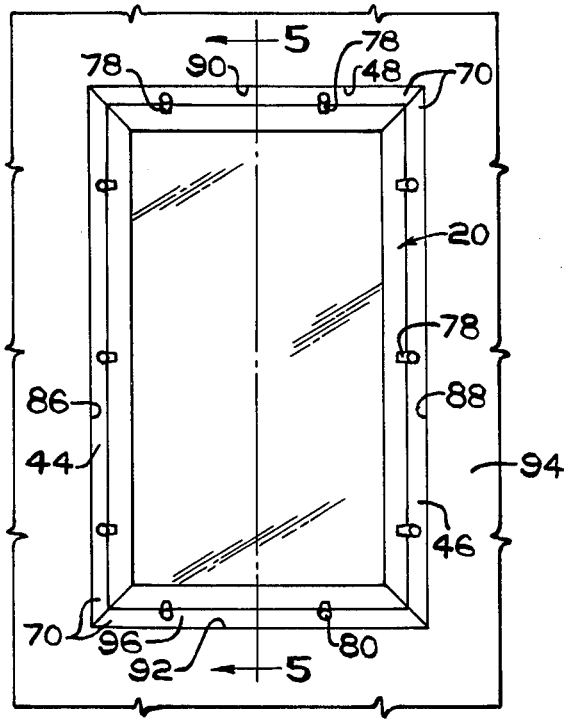
FIG.4
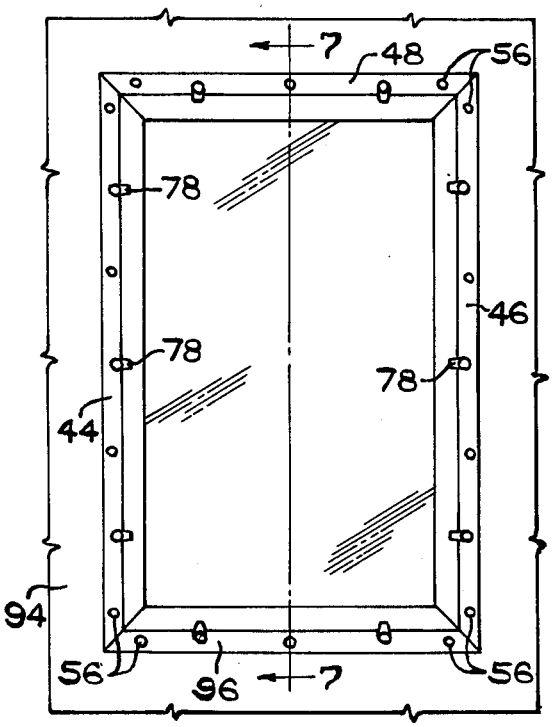
FIG.6
FIG.5
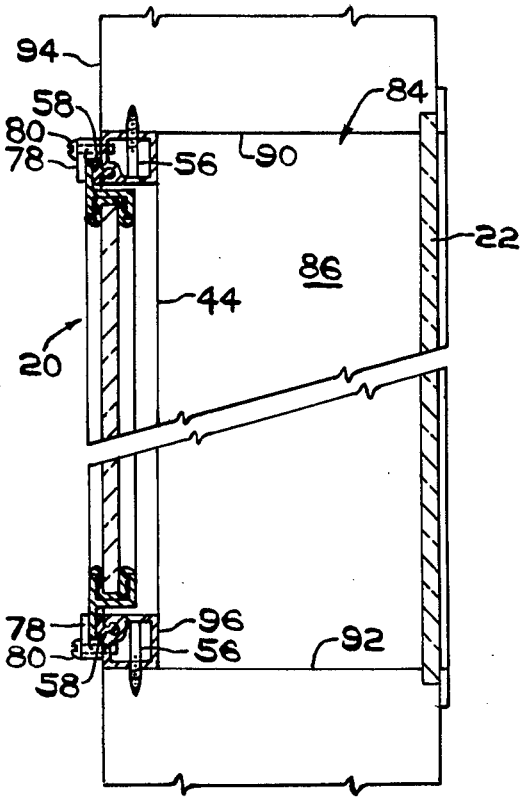
FIG.7
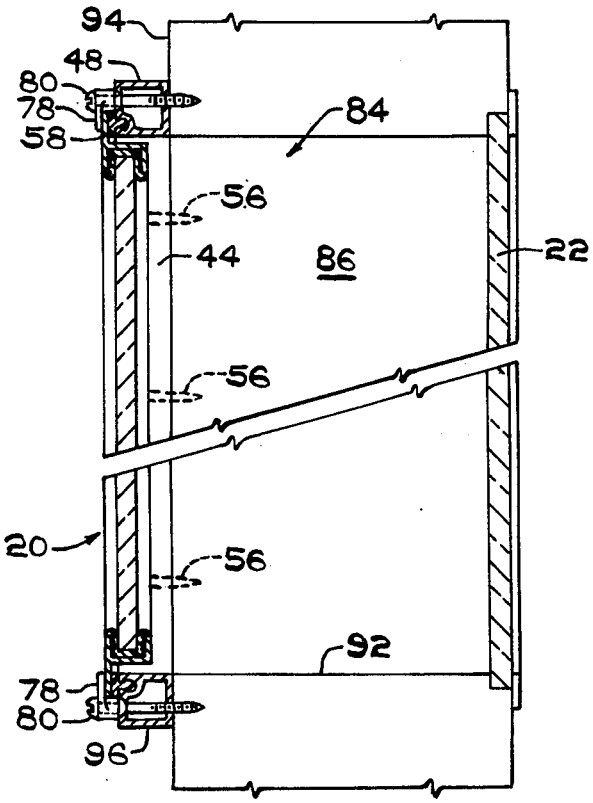

MOUNTING SYSTEM FOR AN ADD ON GLASS PANEL

This is a continuation of application Ser. No. 686,847, filed May 17, 1976.

BACKGROUND OF THE INVENTION

1. Field of the Invention:

This invention relates to a mounting system and more particularly, to a system for mounting a panel in spaced relation to an existing window.

2. Description of the Prior Art:

In the prior art it is recognized to secure glass sheets in spaced relationship to an existing window to provide heat insulation. Representative prior art teachings may be found in U.S. Pat. Nos. 2,047,086; 2,221,005; 2,504,700; 2,545,901; 2,716,783; 3,214,879 and 3,831,319.

In general, U.S. Pat. Nos. 2,221,005; 3,214,879 and 2,716,783 teach that a sheet of glass may be added to a sash in spaced relation to a window secured in the ash. The drawback of this prior art technique is that the mounting facilities are not versatile. More particularly, mounting facilities used for casement windows are not easily adapted to vertically or horizontally sliding sash windows.

U.S. Pat. No. 3,831,319 teaches an anti-glare translucent weather shield pivotally mounted to the outside of a wall structure. For practical reasons, the shield can only be mounted on the outside of this structure. This type of mounting is expensive because structural support, e.g., a platform or ladder is needed when installing the shield.

In general, U.S. Pat. Nos. 2,047,086 and 2,504,700 and 2,545,901 teach the installation of storm windows. The need for frame members to size the opening for the storm windows and installing the frame members makes the practice of the above teachings expensive. Further, the mounting is to the exterior of the structure requiring ladders or other support facilities to install the mountings.

It would be advantageous therefore to provide an inexpensive and versatile mounting system for adding a glass sheet in spaced relation to an existing window. Further it would be advantageous to provide a mounting system that makes the added sheet a noise shield.

SUMMARY OF THE INVENTION

This invention relates to a system for mounting a sheet, e.g., a framed glass sheet, in spaced relation to an existing window mounted in a fenestration formed in a structure. The system includes an abutment mounting the structure in spaced relation to the window to form a sheet receiving surface lying in a plane generally parallel to the plane of the window. Facilities are provided for securing the sheet to the sheet receiving surface of the abutment.

Noise transmission through the existing window may be reduced by providing a resilient material between the sheet and the receiving surface of the abutment.

The invention also relates to a method of installing the above system by securing the sheet to an abutment mounted in spaced relation to the window.

BRIEF DESCRIPTION OF THE DRAWINGS

FIG. 1 is a front view having portions removed for purposes of clarity of a panel mounted in a fenestration in accordance to the teachings of the invention;

FIG. 2 is a view taken along lines 2—2 of FIG. 1 and having portions removed for purposes of clarity;

FIG. 3 is a view taken along lines 3—3 of FIG. 1 and having portions removed for purposes of clarity;

FIG. 4 is a front view of an alternate embodiment of the invention for mounting the panel in the fenestration;

FIG. 5 is a view taken along lines 5—5 of FIG. 4,

FIG. 6 is a front view of another embodiment of the invention for mounting the panel in spaced relation to an existing mounted window; and FIG. 7 is a view taken along lines 7—7 of FIG. 6.

DESCRIPTION OF THE INVENTION

This invention relates to a system for mounting a sheet, e.g., a glass or plastic sheet, in spaced relation to an existing window mounted in a fenestration and reducing noise transmission.

In the following discussion, like numerals refer to like elements.

Referring to FIGS. 1-3, a sheet 20 is mounted in spaced relation to an existing window 22 by abutment or stop moulding 24 constructed in accordance to the teachings of the invention. The window 22, shown in FIGS. 2 and 3, is mounted in any conventional manner in fenestration 26 formed in a room wall 28.

The sheet 20 includes a glass pane 30 having its marginal edges 31 secured in frame 32 in any conventional manner. For example, the frame 32 may include extruded metal sections 34 having a groove 36 formed therein to receive the marginal edge 31 of the pane 30 and a glazing gasket 38 for securing same in the groove 36. A flange 40 is integral with the section 34 to form ledge 42 for receiving the abutment 24 as shown in FIGS. 2 and 3.

In FIGS. 1-3, the abutment 24 includes side sections 44 and 46 and top section 48 secured to side fenestration walls 50 and 52 and top fenestration wall 54, respectively, by screws 56.

The sheet 20 is isolated from building vibration to reduce noise transmission by (1) a resilient gasket 58 positioned between the abutment 24 and ledge 42 of the frame 32 and (2) a strip 60 of resilient material between fenestration ledge 64 and adjacent side of the sheet 20. For example, the resilient gasket 58 may be secured in groove 68 formed in sheet receiving surface 70 (shown in FIG. 1) of the abutment 24. The resilient gasket 58 may be made of rubber, felt or plastic.

The resilient strip 60 may be a glazing foot mounted on the flange 40 of the bottom side of the frame 32. The glazing foot may be a molded piece of rubber or plastic having a groove 72 formed in one end and opposed ringer members 74 extending outward from the other end. The finger members 74 provide a seal when urged against the fenestration ledge 64 as shown in FIG. 3. The interior wall of the groove of the glazing foot is serrated to secure the glazing foot on the flange 40 of the frame 32.

The sheet 20 is held against the abutment by fasteners 78 secured to the surface 70 of the abutment 24 by way of screws 80 shown in FIGS. 1 and 2.

The above embodiment of the invention is preferably practiced when the fenestration ledge 64 extends beyond the room wall 28 as shown in FIG. 3 and/or the fenestration ledge is made of a brittle material, e.g., marble.

With reference to FIGS. 4 and 5, there is shown another embodiment of the invention. As shown in FIG. 5, fenestration 84 has its sidewalls 86 and 88, upper wall 90 and lower wall 92 terminating at room wall 94. The abutment side sections 44 and 46 and top section 48 having the gasket 58 is secured to fenestration wall portions 86, 88 and 92, respectively, as previously discussed for fenestration 26 shown in FIGS. 2–3.

An abutment bottom section 96 having the gasket 58 is secured to the bottom fenestration wall 92 by the screws 56.

The sheet is held in position by the fasteners 80 as previously discussed and as shown in FIGS. 4 and 5.

With reference to FIGS. 6 and 7, there is shown still another embodiment of the invention. The abutment sections 44, 46, 48 and 96, are mounted on the structure wall 94, around the fenestration 84 by the screws 56 as shown in FIGS. 6 and 7.

The mounting system of the invention can be used with any type of existing window construction. This is because the mounting is on the fenestration walls or room walls. Therefore it is independent of the window construction. Further, as discussed for FIGS. 1 3, the instant invention can be practiced when the fenestration ledge is made of brittle material, e.g., marble.

An additional feature of the invention is that outside noise pollution, e.g., objectionable noise, e.g., aircraft, traffic or construction noise transmitted through existing windows is reduced or eliminated. This is accomplished by isolating the sheet 20 from the room walls by the glazing foot 62 and/or resilient gasket 58.

Construction similar to those described above incorporating features of the invention were evaluated for noise suppresion by Acoustical Laboratories of Geneva, Ill. The tests were conducted in explicit conformity with the American Society for Testing and Materials Designations E90-70 and E413-73 as well as other pertinent standards. The specimen tested was a single sheet of ¼ inch (6.35 millimeter) thick glass, 35-¾ inches (0.91 meter) wide and 83-¾ inches (2.13 meters) high placed in a wooden test frame 36 inches (0.91 meter) wide and 84 inches (2.13 meters) high. The glass was contained with wooden stops attached to the frame at the top, bottom and sides on both surfaces. The perimeter of the glass and stops, stops and test frame were caulked.

A single frame of extruded aluminum 36 inches (0.91 meter) wide and 81 inches (2.13 meters) high was approximately placed in the opening. The frame was caulked to the test frame. The frame was 1 inch (25.4 millimeters) wide and ¾ inch (19.1 millimeters) thick and contained a bubble type gasket on the outside.

The first test provided for the glass to be spaced 2 inches (5.08 centimeters) from the inside face of the first layer. A single sheet of 3/16 inch (4.76 millimeters) thick glass in an aluminum frame was placed on the gasket side of the fixed frame and held in place with plastic fasteners around the frame. The glass weighed an average of 5.6 pounds per foot square (27.3 kilograms per meter squared). The transmission area S used in the computations was 21.0 feet squared (1.95 millimeters squared).

Sound transmission loss values are tabulated below at the 18 standard frequencies.

| Frequencies Hurts (CPS) | Transmission Loss, DB | Deficiencies |
|---|---|---|
| 100 | 30 | — |
| 125 | 34 | — |
| 160 | 34 | — |
| 200 | 34 | 1 |
| 250 | 37 | 1 |
| 315 | 40 | 1 |

-continued

| Frequencies Hurts (CPS) | Transmission Loss, DB | Deficiencies |
|---|---|---|
| 400 | 42 | 2 |
| 500 | 43 | 2 |
| 630 | 44 | 2 |
| 800 | 45 | 2 |
| 1,000 | 45 | 3 |
| 1,250 | 47 | 3 |
| 1,600 | 46 | 3 |
| 2,000 | 42 | 7 |
| 2,500 | 43 | 6 |
| 3,150 | 54 | — |
| 4,000 | 55 | — |
| 5,000 | 66 | — |

The sound transmission class is 45. A complete discussion of the test is in Acoustical Laboratories Test TL76-14.

A second test is provided for the glass to be spaced 4 inches (102 millimeters) from the inside face of the first sheet.

The sound transmission loss values are tabulated below at the 18 standard frequencies.

| Frequencies Hurts (CPS) | Transmission Loss, DB | Deficiencies |
|---|---|---|
| 100 | 34 | — |
| 125 | 40 | — |
| 160 | 38 | — |
| 200 | 39 | — |
| 250 | 39 | 3 |
| 315 | 44 | 1 |
| 400 | 45 | 3 |
| 500 | 47 | 2 |
| 630 | 48 | 2 |
| 800 | 49 | 2 |
| 1,000 | 50 | 2 |
| 1,250 | 52 | 1 |
| 1,600 | 51 | 2 |
| 2,000 | 47 | 6 |
| 2,500 | 47 | 6 |
| 3,150 | 51 | 2 |
| 4,000 | 56 | — |
| 5,000 | 59 | — |

The sound transmission class is 49.

A complete discussion of the above test is in Acoustical Laboratories Test TL76-13.

The glass pane 30 may be selectively coated to reduce passage of solar energy during the summer months and/or reduce radiant heat loss from the room during the winter months by coating the glass sheet. For example, SOLARCOOL® coated glass and/or NESA® coated glass taught in U.S. Pat. Nos. 2,724,658; 3,081,200; 3,107,177; 3,410,710 and 3,660,061 and sold by PPG Industries, Inc. may be used. The above identified patents are hereby incorporated by reference.

Although the invention was practiced using a glass pane, the invention is not limited thereto. For example, the invention may be practiced using a sheet of wood, metal, tempered glass or plastic. Further, the resilient gasket 58 between surface 70 of the abutment and flange 40 of the frame 32 may be replaced by a resilient gasket provided between the abutment and the fenestration or structure walls. Still further, the invention contemplates mounting the abutment 24 to the exterior fenestration walls or structure walls, i.e., with the sheet 20 on the exterior of the structure.

DETAILED DESCRIPTION OF THE INVENTION

With reference to FIG. 1, fenestration 26 in wall structure 28 has a window 22 secured therein in any conventional manner. The height of opposed fenestration walls 50 and 52 is 6 feet (1.8 meters), the length of the upper fenestration wall 54 and fenestration ledge 64 is 4 feet (1.2 meters). The depth of the fenestration walls 50, 52 and 54 is 3 inches (7.62 centimeters) and the width of fenestration ledge 64 is 18 inches (0.45 meter).

An abutment 24 made of extruded aluminum having a wall thickness of 1/16 inch (0.16 centimeter) and side dimensions of ¾ inch (1.92 centimeters) is mounted to the fenestration walls 50, 52 and 54 by way of screws 56. Outer sheet receiving surface 70 of the abutment 24 is spaced about 3 inches (7.6 centimeters) from the inner surface of the window 27.

A rubber bubble gasket 58 is secured in groove 68 formed on the surface 70 of the abutment 24.

A sheet 30 of 3/16 inch (4.76 millimeters) thick glass is mounted in an aluminum frame 32. The frame 32 includes a groove 36 and a flange 40 integral therewith to form a ledge 42. The marginal edges 31 of the glass sheet 30 are secured in the groove of the frame by a glazing gasket 38. The outer dimension of the frame is 5½ feet by 4½ feet (1.6 meters × 1.3 meters).

Bottom flange of the frame as viewed in FIG. 1 is secured in groove 72 of a plastic glazing foot 60. A pair of opposed flexible fingers 74 are formed on the side of the glazing foot opposite the groove 70 to seal the space between the fenestration ledge and adjacent frame flange as shown in FIG. 3.

The framed glass pane is mounted over the fenestration 26 by resting the glazing foot 60 on the fenestration ledge 64 with the frame ledge 42 against the abutment 24. Fasteners 78 screwed to the surface 70 of the abutment 24 secure the framed glass in position.

As can be appreciated, the invention is not limited to the above example which is presented for illustration purposes only.

What is claimed is:

1. A system for mounting a sheet in spaced relation to an existing glazing to convert the existing glazing into an acoustical glazing, the existing glazing having a pane mounted in a frame with the frame mounted in a building wall structure, comprising:

an abutment secured on the building wall structure in spaced relation to the existing glazing, said abutment having a sheet receiving surface in spaced relation to the existing glazing;

a sheet;

means for securing said sheet to said sheet receiving surface of said abutment; and means mounted between said sheet and the building wall structure having said abutment for isolating said sheet from structural vibrations.

2. The mounting system as set forth in claim 1 wherein the sheet is a glass sheet; the building wall structure having the existing glazing mounted therein includes a pair of opposed generally vertical wall portions, an upper generally horizontal wall portion and a ledge portion; and said abutment includes:

an elongated member secured to each of the opposed vertical wall portions and the horizontal upper portion of the building wall structure; and said isolating means includes means (1) between said sheet and the sheet receiving surface and (2) between the ledge portion and adjacent peripheral edge portions of said sheet.

3. The mounting system as set forth in claim 1 wherein the sheet is a glass sheet; the building wall structure having the existing glazing mounted therein includes a pair of opposed generally vertical wall portions and a pair of opposed generally horizontal wall portions and said abutment includes:

an elongated member secured to each of the opposed vertical wall portions and to each of the horizontal wall portions of the building wall structure; and said isolating means includes resilient means between said sheet and the sheet receiving surface.

4. The mounting system as set forth in claim 1 wherein said isolating means is rubber.

5. A method of mounting a sheet in spaced relation to an existing glazing to convert the existing glazing into an acoustical glazing wherein the existing glazing includes a pane mounted in a frame with the frame mounted in a building wall structure, comprising the steps of:

mounting an abutment on the building wall structure in spaced relation to the existing glazing to provide a sheet receiving surface in spaced relation to the existing glazing;

securing a sheet on the sheet receiving surface; while isolating the sheet from structural vibrations.

6. The method as set forth in claim 5 wherein the building wall structure having the existing glazing mounted therein includes a pair of opposed generally vertical wall portions, a generally horizontal wall portion and a ledge portion and wherein said mounting step includes the step of:

securing an elongated member to each of the opposed vertical wall portions and horizontal wall portions of the building wall portion; and said isolating step includes the step of providing resilient means (1) between the sheet receiving surface and the sheet and (2) between the ledge of the building wall structure and adjacent peripheral edge portions of the sheet.

7. The method as set forth in claim 5 wherein the building wall structure having the existing glazing mounted therein includes a pair of opposed generally vertical wall portions and a pair of opposed generally horizontal wall portions and wherein said mounting step includes the step of:

securing an elongated member to each of the opposed vertical wall portions and to each of the opposed horizontal wall portions of the building wall structure; and said isolating step includes the step of providing resilient means between the sheet receiving surface and the sheet.

* * * * *